United States Patent [19]

Visconti

[11] 4,221,136

[45] * Sep. 9, 1980

[54] SEWING MACHINE AND SPEED ADJUSTMENT MECHANISM THEREOF

[76] Inventor: Matthew J. Visconti, 547 Liberty Pl., Ridgefield, N.J. 07657

[ * ] Notice: The portion of the term of this patent subsequent to Aug. 9, 1996, has been disclaimed.

[21] Appl. No.: 778,874

[22] Filed: Mar. 18, 1977

[51] Int. Cl.[2] ..... F16H 29/04

[52] U.S. Cl. ..... 74/117; 74/571

[58] Field of Search ..... 74/117, 571; 192/12 B, 192/12 BA

[56] References Cited

U.S. PATENT DOCUMENTS

| | | | |
|---|---|---|---|
| 2,033,639 | 3/1936 | Lotts | 74/117 |
| 2,521,711 | 9/1950 | Galliano | 74/117 |
| 3,422,941 | 1/1969 | Fredell | 192/12 B |
| 3,572,481 | 3/1971 | Moritz | 192/12 BA |
| 3,726,371 | 4/1973 | Versoy | 192/12 BA |
| 3,908,474 | 9/1975 | Cole | 74/117 |

*Primary Examiner*—Samuel Scott
*Assistant Examiner*—Wesley S. Ratliff, Jr.
*Attorney, Agent, or Firm*—Leon Nigohosian

[57] ABSTRACT

A mechanical system for speed adjustment, comprising mechanical driving means and a driven shaft member, with linking means between the driving source and the drive shaft member for driving the latter, the system further comprises a crank element comprising an eccentric disc disposed on the driven shaft member and a connecting rod driven by the eccentric disc, the connecting rod comprising an arm portion that rides the eccentric disc. Also included are means for adjusting the eccentricity of the eccentric disc with respect to the driven shaft, which adjusting means comprises a spacing element movable into and from a position between the crank element and the driven shaft, the system also contains an output shaft element driven by the connecting rod.

40 Claims, 5 Drawing Figures

SEWING MACHINE AND SPEED ADJUSTMENT MECHANISM THEREOF

BACKGROUND OF THE INVENTION

The present invention relates to a mechanical system for speed adjustment, particularly to one for adjusting drive speed for a motor.

Prior art devices, such as that described in U.S. Pat. No. 2,691.896, are said to provide variable speed power transmission but such devices necessarily comprise a complicated system containing a large number of moving parts, which leads to increased cost of manufacture and a greater likelihood for mechanical malfunction.

Other such devices, particularly those used more commonly with commercial sewing machines, in order to achieve variation of the output speed (i.e., the variation of the drive speed) to, e.g., a feeding mechanism for moving a workpiece past the sewing needle, require that the device be partially disassembled, leading to increased time and expense for changing the output speed.

The present invention significantly alleviates, or even overcomes substantially, the above drawbacks by providing a greatly simplified mechanism whose output speed is readily and rapidly adjusted and that is considerably less expensive to produce than many variable speed transmission devices heretofore known to the art.

PREFERRED EMBODIMENT

Figure 1:
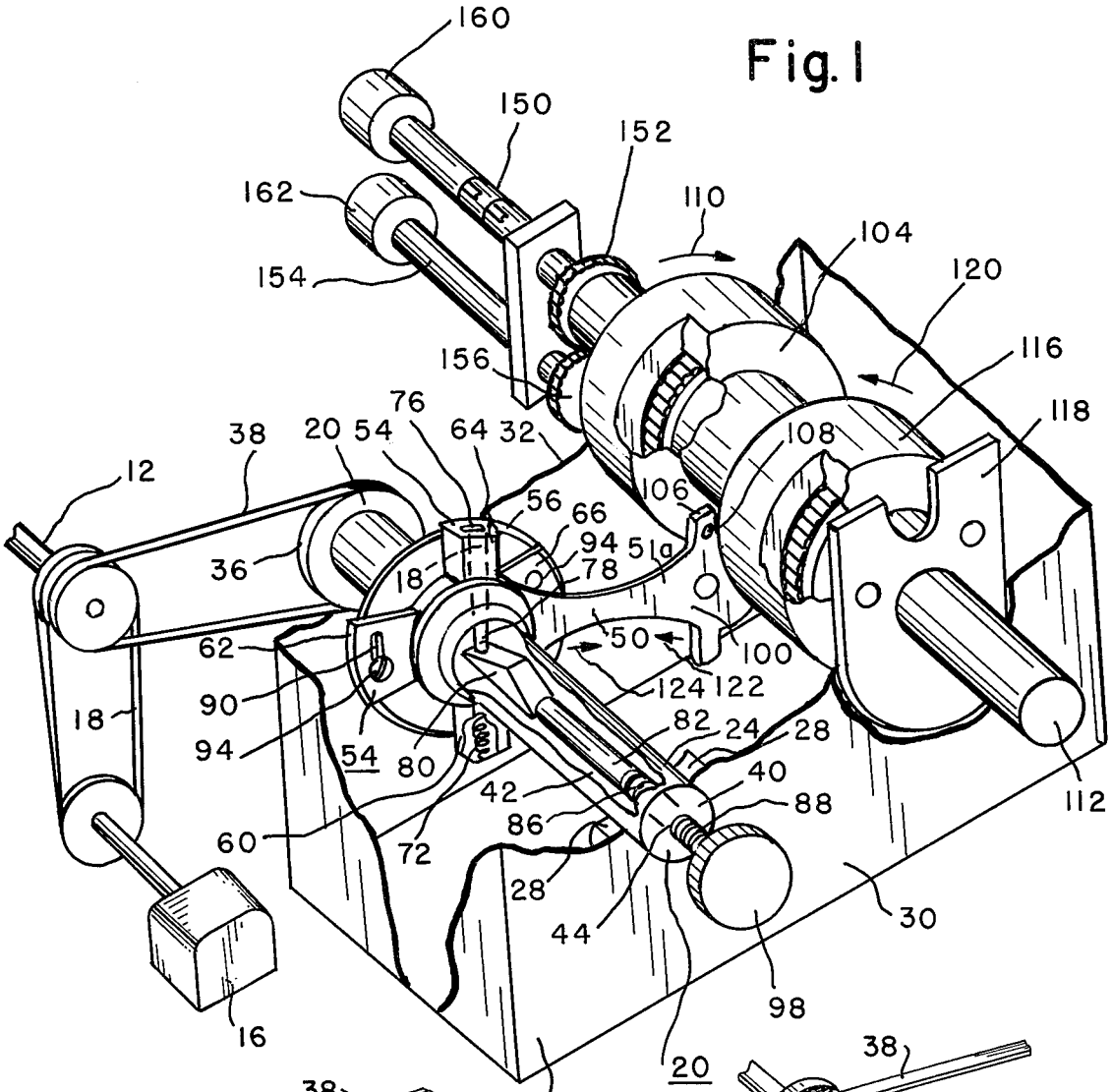
FIG. 1 is a partially cut-away perspective view of the present invention.
Figure 1A:
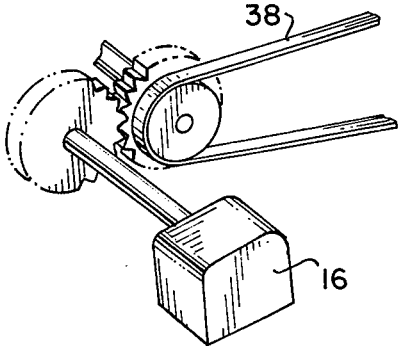
FIGS. 1*a* and 1*b* show, partially in perspective, alternative embodiments of the drive mechanism.
Figure 1B:
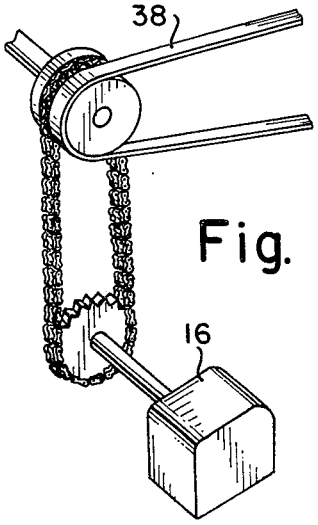

Referring to FIG. 1, the present transmission system 10 comprises a power transmitting shaft 12 which can be, for example, the main drive shaft of a mechanical apparatus, such as a commercial sewing machine unit that, in turn, is driven by the rotor 16 of an electric motor or other suitable driving means. The rotor 16 and the power transmitting shaft 12 can be mechanically linked by any suitable linking means, including for example, a gear train 18*a* or belt 18 (e.g., mechanical linkage chain belt 18*b*, or a flexible rubber belt 18).

The system 10 further comprised a driven shaft 20 (which is shown in partial fragmentary view) that can be located within a separate housing 22, the driven shaft 20 preferably having its end portions 24, 26 journaled in bearings 28, (only one of which is shown for simplicity) that can be disposed at, for example, the walls 30, 32, of the housing or at some other suitable place. At an end portion 26 of the driven shaft 20 there can be located a pulley 36 at which there is a flexible belt 38 or other linking means that links the driven shaft 20 with the power transmitting shaft 12. As a possible alternative to the pulley, there can be used, e.g., a sprocket, with a chain belt being employed instead of the flexible belt.

Along at least a portion of its length extending from an end 40 thereof, the driven shaft 20 has a passageway or interior chamber 42 that ends at opening 44 at end 40. The interior chamber 42 may comprise a key slot that extends along at least a portion of the length of the shaft 20 or the interior of the shaft 20 may be hollow so that the shaft 20 is annular. Instead of these, the passageway can be of other forms.

Disposed on the driven shaft 20 is a crank 47 in the form of, preferably, an eccentric dic 48 and a connecting rod 50, only one of each being necessary. The connecting rod 50 comprises an arm portion 51*a* and a crank end portion 51*b*. The eccentric disc 48, which can be in the form of a sleeve, for example, and has an interior bore 55, is located at an interior opening 52 located in the crank end portion 51*b* of the connecting rod 50 and engages the connecting rod 50 at this opening 52, the crank end portion 51*b* riding on the eccentric disc 48, the eccentric disc 48 and, therefore, the crank end portion 51*b* of the connecting rod 50 being adjustably eccentric with respect to the axis of the driven shaft 20 so as to produce the desired throw when the driven shaft 20 is rotated.

Figure 2:
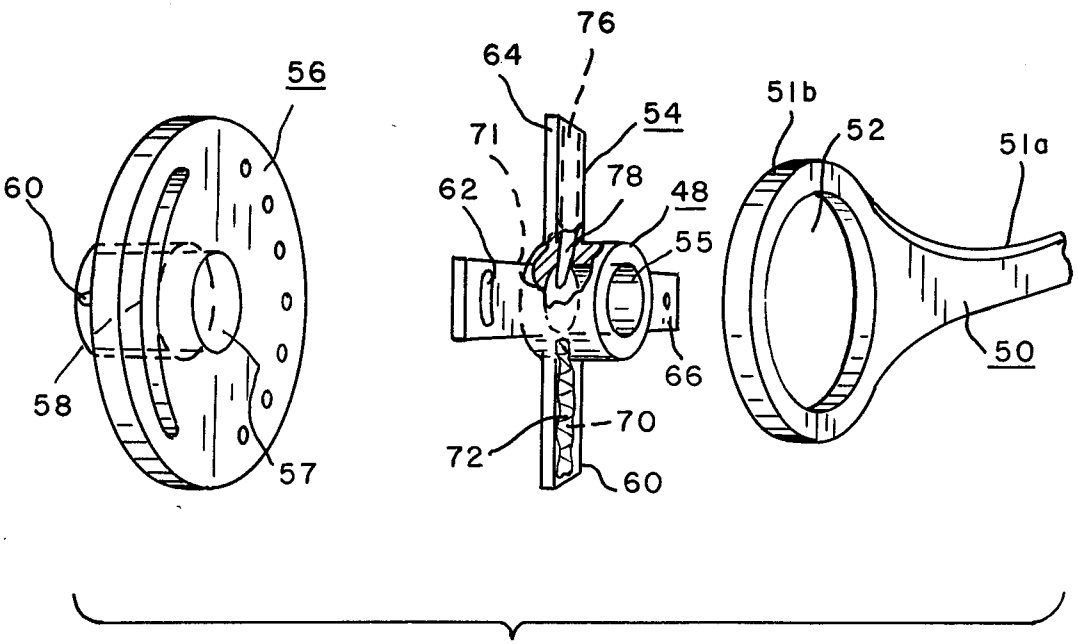
FIG. 2 is an expanded partially cut-away view of a particular aspect of the invention shown in FIG. 1.

It is preferred that bearings be located between the eccentric disc 48 and the crank end portion 51*b* to permit the rotation of the former within the interior opening 52 of the connecting rod 50. The eccentric disc 48 can be fixed via a bracket member 54 to a plate or flange member 56 which contains an interior opening 57 (see FIG. 2) through which the driven shaft 20 passes, the shaft 20 being rotatable within the opening 52. The bracket member 54 comprises portions 60, 62, 64, and 66, such bracket portions preferably being angularly oriented to each other so as to form an essentially cross-shaped or other suitable configuration. Where it is desired, the bracket member 54 and eccentric disc 48 can be separate pieces that are joined together or can form an integral piece, with the disc 48 being a hub.

The bracket 54 is, according to a more preferred embodiment of the invention, adjustably mounted on the plate or flange member 56, as explained below. According to a preferred form, the eccentric disc 48, bracket 54, and plate 56 form a unitary body, these various components being joined together, e.g., by welding or other suitable means. The plate or flange member 56 preferably comprises an annular collar or sleeve portion 58, (see FIG. 2) that can be located on the side opposite the eccentric disc 48 and that contains a tapped hole for receiving a set screw or pin 60 or other means for engaging the driven shaft 20, so that the plate member 56 and eccentric disc 48 rotate with the shaft 20 (which can have a slot or hole for receiving the set screw or other means).

A first bracket portion 60 is generally elongated and comprises an interior chamber or slot 70 that extends in the direction of elongation, such first bracket portion 60 containing a spring element 72 or other suitable biasing means. One end of the spring element 72 can engage the first bracket portion 60 at, e.g., the end wall, and the other end can engage the shaft 20, the spring element preferably being in compression so that the first bracket portion 60 is urged away from the shaft 20, the plate 56 and the eccentric disc 48 connected thereto being carried with the first bracket portion 60 by virtue of the biasing effect of the spring element 72. The chamber 70 is closed by an end wall at the end more remote from the driven shaft 20 and opens into the interior opening 71 of the bracket element 54, while the second bracket portion 64, which preferably is disposed generally opposite the first bracket portion 60, also contains a chamber 76 at its interior, the second bracket portion 64 preferably being elongated and the chamber or slot 76 preferably extending along the direction of elongation. The chamber 76 preferably is a blind hole having an opening at the interior opening 71 of the bracket element 54. A pin element 78 is movably disposed within the chamber 76, it having a length exceeding that of the chamber 76, so that the pin element 78 protrudes (see FIG. 2) from the chamber 76 into the interior opening 71 of the bracket element 54 and engages the driven shaft 20.

Figure 3:
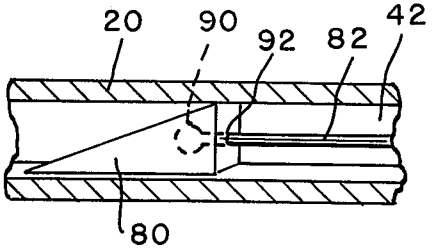
FIG. 3 is a fragmentary sectional view of another aspect of the invention shown in FIG. 1.

Located within the hollow interior passageway 42 (which is, e.g., a key slot)of the driven shaft 20, is a shim-like or wedge-shaped spacing element 80 and a spindle element 82, the spindle element 82 being threaded along at least a portion 86 of the length thereof (and preferably along the entire end portion remote from the spacing element 80). The driven shaft 20 comprises at end wall 40 a tapped hole 44 into which the threaded portion 86 of the spindle element 82, is screwed. The end 88 of the spindle element 82 preferably projects from the housing so as to facilitate adjustment of the throw of the eccentric disc 48 and, therefore, the transmission speed, as explained hereinafter. The other end 90 of the spindle element is, according to a first embodiment, connected to the spacing element, it being preferred that the end 90 be rotatably disposed within a bore 92 (FIG. 3) in the wedge-shaped spacing element 80, so that, when the spindle element 82 is screwed into or out of the driven shaft 20, the shim-like element or wedge-shaped spacing element will move along the passageway or slot 42 toward a more interior point or toward the end wall 40, depending on the direction in which the spindle element 82 is turned. An example of the type of arrangement that can be used for connecting the spacing element 80 and the spindle element 82, is a ball-and-socket joint, with the ball 90 being located at the end of the spindle element 82.

As the wedge shaped specing element 80 is driven further to the interior of the passageway 42, it engages the pin element 78 and raises the pin element as spacing element 80 moves, counteracting the force of the spring element 72 or other biasing means that might be employed. The pin element 78 raises the second bracket portion 64 which it engages at chamber 76, and which carries with it the plate 56 and eccentric disc 48, which results in the variation of the eccentricity of the plate 56 and eccentric disc 48 with respect to the driven shaft 20, and therefore, a variation in the throw that results when the shaft 20 is rotated. Such adjustment of the throw of the eccentric disc 48 affects the motion translated to the connecting rod 50 and, therefore, adjusts the ultimate output speed as described hereinafter.

The bracket third and fourth portions 62 and 66, respectively, are preferably disposed generally opposite each other and substantially at right angles to the first and second bracket portions. The third bracket portion 62 preferably contains an arcuate slot 90 and the fourth bracket portion 66 preferably contains a bore 92, these screws connecting the bracket 54 to the plate 56, which preferably contains a number of holes 96 (FIG. 2) at which these screws can be located so as to vary the position of the bracket 54 with respect to the plate 56 and thereby vary the eccentricity of the plate 56, and therefore the orientation of the eccentric disc 48, with respect to the shaft 20. By moving the bracket 54 so that the position of the screw 94 at slot 90 is varied within the slot, further adjustment of the eccentricity of the eccentric disc can be achieved.

When the wedge-shaped element 80 is moved as described above, thus raising or lowering the eccentric disc 48 (which acts as a cam) with respect to the driven shaft 20 (i.e., adjusting the position of the shaft 20 within the bore 55 of the eccentric disc 48, the size of the bore 55 being such as to provide sufficient clearance to the driven shaft 20 and allowing the movement of the disc 48 with respect to the driven shaft 20 e.g., horizontal or vertical) the degree of eccentricity of the cam or disc 48 is adjusted, this merely by turning the spindle element 82 in the appropriate direction, a knob 98 preferably being provided at the end thereof. The degree of eccentricity of the eccentric disc 48, which drives the connecting rod 50, determines the amount of translational movement of the connecting rod 50 and thus determines the output speed of the system.

The connecting rod 50 has one end 100 of the arm portion **51*a* thereof pivotably connected, to a rachet clutch 104 via a stem or arm element 106 that is fixedly connected to the overrunning clutch 104, the arm portion 51*a* being pivotably connected via, e.g., a pin 108 or other suitable means. The rachet clutch 104 is of the type that registers motion in only a single rotational direction, e.g., clockwise, as indicated by arrow 110, and is connected to and mounted on a second, or output, shaft 112 so as to translate unidirectional motion (imparted by the connecting rod 50) to the shaft 112. By the connecting rod, or crank, 50 being driven back and forth by the eccentric disc 48 (the amount of back and forth motion being determined by the eccentricity of the disc 48) arm element 50 is also driven and the arm 50 drives the overrunning clutch 104 and therefore the shaft 112**.

The system 10 further includes a second, or shaft, clutch 116 and a brace 118 that is secured to the housing 22, the shaft clutch 116 being connected to the shaft 112 and to the brace 118. The shaft clutch 116 is also of the type that registers motion in only a single rotational direction, namely, the direction opposite to the rachet clutch 104, or counterclockwise as indicated by arrow 120. The purpose of the shaft clutch 116 is to avoid the clockwise motion of the output shaft 112 when the connecting rod 50 is being returned (arrow 122) by the driving eccentric disc 48 (during the backward stroke of connecting rod 50), which return follows the lateral or translational driving motion, or power stroke, (arrow 124) of the connecting rod to drive the clutch 104.

In the operation of the apparatus employing the mechanism shown in FIG. 1, rotational movement is imparted to the driven shaft 20 via the force transmitting arrangement comprising the rotor 16 (or other driving means), power transmitting shaft 12, pulley 36, and the linking means 18, 38. By proper adjustment of the spacing element 80, via the spindle element 82, the pin element 78 (which preferably is essentially limited to axial movement within the chamber or slot 76 ) is displaced, thereby varying the relative positions of the eccentric disc 48 and the connecting rod 50, so that as the eccentric disc 48 is rotated with the driven shaft 20, translational motion is imparted to the connecting rod 50, which is engaged by the eccentric disc. The degree of translational movement of the connecting rod is determined by the eccentricity of the disc 48 and, therefore, the throw provided by this disc 48.

Because of the clutch arrangement, the shaft 112 is driven only by the driving stroke of the connecting rod 50, and not by the return stroke. Hence, the greater the degree of throw provided by the eccentric disc 48, the greater will be the translational displacement of the connecting rod 50 and, as a result, the greater will be the rotational displacement of the shaft 112 for each stroke of the connecting rod and the greater will be the rotational speed of the driving means 160, 162. Of course, with a smaller throw, the rotational displacement of the shaft 112 will be smaller per stroke of the connecting rod 50.

The shaft 112 preferably is journaled in bearings (not shown) mounted at the walls of the housing 22. At one end of the output shaft 112, there is, preferably, a universal coupling 150 and a gear wheel 152. The system also includes another shaft 154 that carries a gear 156 that engages and is driven by gear wheel 152 mounted on the output shaft 112 and there are suitable means for driving a workpiece (e.g., fabric, where the system is to be used with a sewing machine) located at respectively, the shafts 112 and 154. The driving means on these shafts 112, 154 can be, for example, gears, rollers, or wheels 160, 162, respectively, that can engage the workpiece between them and drive the workpiece.

Although the oscillating or back and forth motion of the crank, or connecting rod 52 moves the shaft 112 incrementally, the operation of the driven shaft 20 at a relatively high rotational speed, e.g., several hundred revolutions per minute, will result in a rapid rotation of the driving means 160,162 so that they can be considered to move almost continuously.

I claim:

1. A mechanical system for speed adjustment, comprising:

(a) mechanical driving means, (b) a driven shaft member, (c) linking means between said driving means and said driven shaft member for driving the latter, (d) a crank element comprising (i) an eccentric disc disposed at said driven shaft member, (ii) a connecting rod driven by said eccentric disc, comprising an arm portion that rides said eccentric disc, (iii) a bracket member disposed at said driven shaft member and connected to said eccentric disc, said bracket member comprising plural portions angularly oriented to each other, (e) means for adjusting the eccentricity of said eccentric disc with respect to said driven shaft, said adjusting means comprising a spacing element movable into and from a position between said crank element and said driven shaft, and (f) an output shaft element driven by said connecting rod.

2. A mechanical system as in claim 1, wherein said connecting rod further comprises a crank end portion and said system further comprises a first clutch member disposed on said output shaft element, said connecting rod being mechanically linked to and driving said first clutch member, whereby said clutch member drives said output shaft element in a predetermined rotational direction.

3. A mechanical system as in claim 2, wherein said system further comprises a second clutch member, disposed on said output shaft element, said second clutch member regulating the rotational movement of said output shaft element in a direction opposite said predetermined direction.

4. A mechanical system as in claim 1, wherein said bracket member comprises cross-pieces and a central opening for receiving said driven shaft.

5. A mechanical system as in claim 1, wherein said crank element further comprises a plate member comprising a central opening for receiving said driven shaft, said plate member being connected to said bracket member.

6. A mechanical system as in claim 5, wherein said plate member comprises plural apertures for receiving means for connecting said bracket member thereto.

7. A mechanical system as in claim 5, wherein said plate element comprises a sleeve portion that comprises a central opening for receiving said driven shaft.

8. A mechanical system as in claim 7, wherein said sleeve portion comprises means for removably connecting said crank element to said driven shaft so that they rotate together.

9. A mechanical system as in claim 8, wherein said connecting means comprises a set screw or pin and an aperture for receiving said set screw or pin, said driven shaft comprising a slot or recess for receiving said set screw.

10. A mechanical system as in claim 1, wherein said bracket member and said eccentric disc comprise an integral structure.

11. A mechanical system as in claim 1, wherein said bracket member comprises plural portions, a first said bracket portion being generally elongated and comprising an interior chamber extending generally in the direction of elongation, said system containing a pin element disposed at said interior chamber and exceeding the length of said chamber so that it engages said driven shaft member.

12. A mechanical system as in claim 11, comprising an elongated second said bracket portion that contains a second interior chamber extending generally in the direction of elongation, said system comprising biasing means disposed at said second interior chamber and serving to urge said second bracket portion away from said driven shaft.

13. A mechanical system as in claim 11, wherein said interior chamber of said first bracket portion is a blind hole, said bracket member comprising a central opening for receiving said driven shaft and said interior chamber opening into said central opening.

14. A mechanical system as in claim 12, wherein said second bracket portion is disposed generally opposite said first bracket portion.

15. A mechanical system as in claim 12, wherein said bracket portion comprises an end wall closing said second chamber and located at the end of said second bracket portion more remote from said driven shaft, said bracket member comprising a central opening for receiving said driven shaft and said second chamber opening into said central opening, said biasing means engaging said driven shaft.

16. A mechanical system as in claim 12, wherein said biasing means comprises a spring element.

17. A mechanical system as in claim 12, wherein said bracket member comprises third and fourth bracket portions that contain apertures extending therethrough, said crank element comprising a plate member that contains a central opening for receiving said driven shaft and plural apertures therein, said bracket member and said plate member being removably connected together via connecting means disposed at their respective said apertures.

18. A mechanical system as in claim 1, wherein said driven shaft comprises an interior chamber extending along at least a portion of its length and said adjusting means slidably disposed therein.

19. A mechanical system as in claim 18, wherein said driven shaft is annular in cross-sectional shape.

20. A mechanical system as in claim 18, wherein said adjusting means comprises a wedge-shaped element.

21. A mechanical system as in claim 18, wherein system comprises a movable spindle element insertable into and retractable from said interior chamber of said driven shaft and said adjusting means is disposed at said spindle element.

22. A mechanical system as in claim 21, wherein said adjusting means and said spindle element are connected by a ball-and-socket joint.

23. A mechanical system as in claim 21, wherein said spindle element is threaded along at least a portion of its length and said driven shaft comprises an end wall closing the interior chamber thereof, said end wall containing a tapped aperture into which said spindle element thread is screwed.

24. A mechanical system as in claim 21, wherein said spindle element is rotatably connected at a first end thereof to said adjusting means.

25. A mechanical system as in claim 1, further comprising a workpiece driving element associated with said output shaft element and an universal coupling member that is connected to said output shaft element and located between said output shaft element and said workpiece driving element.

26. A mechanical system as in claim 1, further comprising a housing containing at least portions of said driven shaft member, linking means, crank element, eccentricity adjusting means, and output shaft element.

27. A mechanical system as in claim 1, wherein said linking means comprises a flexible belt.

28. A mechanical system as in claim 1, wherein said linking means comprises a gear train.

29. A mechanical system as in claim 1, wherein said linking means comprises a chain belt.

30. A mechanical system as in claim 1, further comprising bearings disposed between said eccentric disc and connecting rod.

31. A sewing machine comprising the mechanical system defined in claim 1, wherein said driving means comprises the electric motor rotor and the power transmitting shaft of said sewing machine.

32. A mechanical system for speed adjustment, comprising:

(a) mechanical driving means,
(b) a driven shaft member,
(c) linking means between said driving means and said driven shaft member for driving the latter,
(d) a crank element comprising
  (i) an eccentric disc disposed on said driven shaft member,
  (ii) a connecting rod driven by said eccentric disc, comprising an arm portion that rides said eccentric disc,
  (iii) at least a bracket element, said eccentric disc and said bracket element comprising a structure having a central opening for receiving said driven shaft, said central opening having dimensions exceeding the cross-sectional dimensions of said driven shaft, such that said crank element is radially movable with respect to said driven shaft,
(e) means for adjusting the eccentricity of said eccentric disc with respect to said driven shaft, said adjusting means comprising a spacing element movable to and from a position between said crank element and said driven shaft, and
(f) an output shaft element driven by said connecting rod.

33. A mechanical system as in claim 32, wherein said crank element further comprises a plate member having a central opening greater than the cross-sectional dimensions of said driven shaft.

34. A mechanical system as in claim 33, wherein said crank element further comprises means for removably securing said crank element to said driven shaft so that they are rotatable together, said securing means permitting said crank element to be moved radially with respect to said driven shaft element.

35. A mechanical system for speed adjustment, comprising:

(a) mechanical driving means,
(b) a driven shaft member,
(c) linking means between said driving means and said driven shaft member for driving the latter,
(d) a crank element comprising
  (i) an eccentric disc disposed at said driven shaft member,
  (ii) a connecting rod driven by said eccentric disc, comprising an arm portion that rides said eccentric disc,
  (iii) a bracket member disposed at said driven shaft member and connected to said eccentric disc, said bracket member comprising plural portions angularly oriented to each other,
(e) means for adjusting the eccentricity of said eccentric disc with respect to said driven shaft, said adjusting means comprising a spacing element movable into and from a position between said crank element and said driven shaft,
(f) an output shaft element driven by said connecting rod,
(g) a further shaft element, and
(h) means for connecting said output shaft element and said further shaft element.

36. A mechanical system as in claim 30, wherein said drive means comprises a gear train.

37. A mechanical system as in claim 35, wherein said system further comprises means for driving a workpiece, said means being connected to said output and further shaft elements.

38. A mechanical system as in claim 37, wherein said workpiece driving means comprises wheels.

39. A mechanical system as in claim 37, wherein said workpiece driving means comprises gears.

40. A mechanical system as in claim 37, wherein said workpiece driving means comprises roller elements.

* * * * *